343-872
8/17/76 XR 3,975,737 SR

United States Patent [19]
Jones, Jr. et al.

[11] 3,975,737
[45] Aug. 17, 1976

[54] RADOME-ANTENNA STRUCTURE

[75] Inventors: Howard S. Jones, Jr., Washington, D.C.; Frank Reggia, Bethesda, Md.

[73] Assignee: The United States of America as represented by the Secretary of the Army, Washington, D.C.

[22] Filed: Nov. 7, 1975

[21] Appl. No.: 629,819

[52] U.S. Cl. ..... 343/770; 343/872
[51] Int. Cl.[2] ..... H01Q 1/42; H01Q 13/18
[58] Field of Search ..... 343/705, 708, 770, 771, 343/872

[56] References Cited

UNITED STATES PATENTS 3,914,767 10/1975 Jones ..... 343/708

*Primary Examiner*—Eli Lieberman
*Attorney, Agent, or Firm*—Nathan Edelberg; Robert P. Gibson; Saul Elbaum

[57] ABSTRACT

A radome-antenna structure includes a radome of lowloss dielectric material, the inner surface of which is plated with a copper shield having at least one aperture therethrough. A conformal radiating element is aligned with the aperture to direct radio frequency radiation through the aperture to the exterior of the radome. Generally, the radiating element consists of a dielectric substrate, which is surrounded by a copper shield. If necessary, a plurality of apertures and radiating elements may be included in a single radome. The radiating elements may be round or wedge shaped or may assume any advantageous configuration, as long as they conform to the geometry of the inner surface of the radome and do not leak radiation into the radome.

8 Claims, 4 Drawing Figures

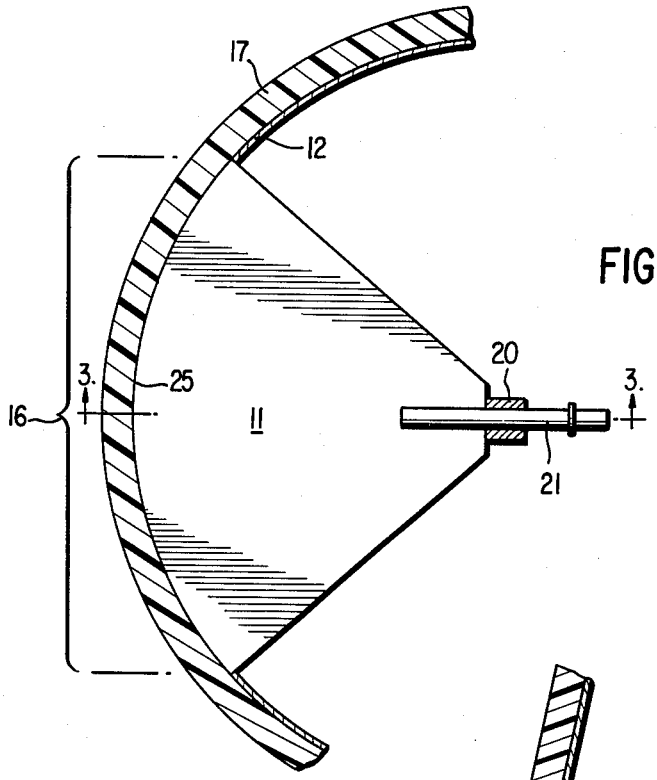
FIG. 2
FIG. 3
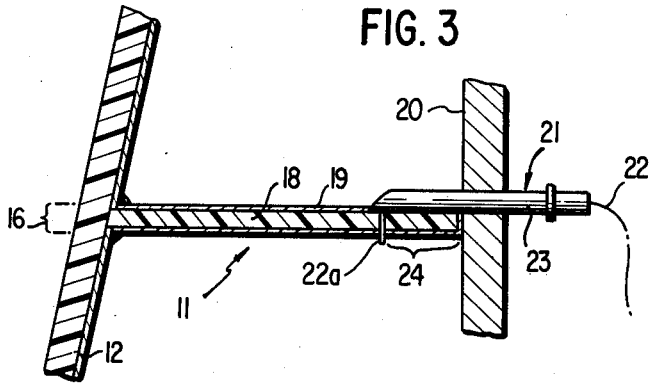
FIG. 4
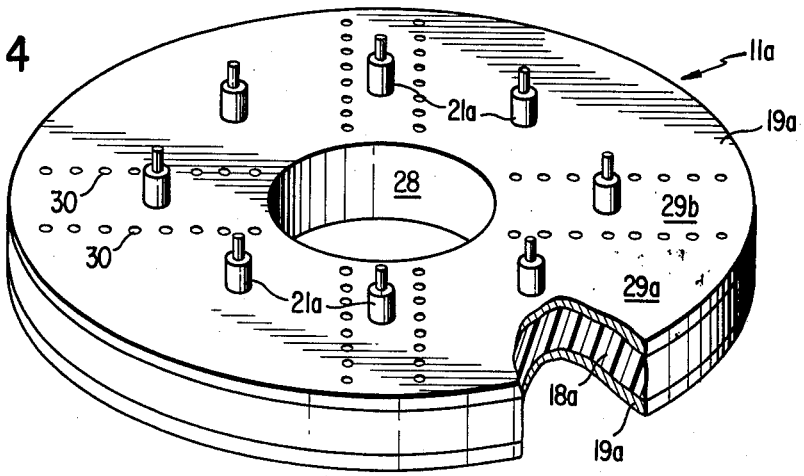

RADOME-ANTENNA STRUCTURE

RIGHTS OF THE GOVERNMENT

The invention described herein may be manufactured, used and licensed by or for the U.S. Government for governmental purposes without payment to us of any royalty thereon.

BACKGROUND OF THE INVENTION

1. Field of the Invention

This invention relates generally to antennas and more particularly to an antenna which is combined with and a part of a radome structure used on an aircraft, projectile, guided missile, or the like.

2. Technical Considerations and Prior Art

Airborne or vehicle-carried radar equipment is almost always covered by a plastic or dielectric radome which is substantially transparent to electromagnetic energy but which provides mechanical protection for the equipment and contributes to the streamlining of the vehicle. Situated within the radome itself is the antenna system of the radar equipment. Typically, the antenna system is servo-actuated to provide mechanical scanning. Although such structures have served their purposes satisfactorily in the past, they have become less satisfactory with the increased complexities and sophistication of today's modern radar equipment. There has been a pressing need for a reduction in both bulk and cost of radar equipment to make modern equipment competitive with less accurate equipment in many applications. It is necessary that this be accomplished without sacrificing electrical performance. With the advent of simple and compact phase shifting devices, electrical scanning of radar antennas has become practical, and servo-actuated antenna arrays have been replaced with fixed positioned arrays. There has thus resulted some decrease in size, weight and expense in radar equipment; however, these improvements, while abating the problem, have not eliminated it.

In many cases, the fixed antenna systems are designed independently of the radome and radiate through the radome into free space. While this approach is widely accepted, there are still many problems, because since the radome and antenna are separate components, there is antenna-radome interference caused by air gaps, improper bonding, etc., which distorts the radiation pattern. Furthermore, scattered radio frequency energy is difficult to control with this arrangement, and frequently finds its way into the electronic system controlling the antenna and the vehicle. The cost of designing and constructing separate components and then matching the components together is quite high, since such design and construction must eliminate or at least minimize the afore-mentioned problems.

Various attempts have been made to mount the antenna flush with the skin of the carrying vehicle in order to obviate these problems. A successful approach is disclosed in U.S. Pat. No. 3,346,865, issued to one of the inventors of the instant invention. However, this approach does not provide the flexibility which is sometimes desired in missile design. Generally, the antenna disclosed in U.S. Pat. No. 3,346,865 is limited to high-frequency operation and does not readily adapt to multifunctional approaches, wherein different frequencies, multiphased and multidirectional operation would be advantageous. In view of these considerations, a more flexible approach is required.

OBJECTS OF THE INVENTION

It is, therefore, an object of this invention to provide a new and improved radome-antenna structure.

It is an additional object of the instant invention to provide a new and improved radome-antenna structure which is flexible in operation, and which has radio frequency beams that are multifunctional, omnidirectional, multiphased and multifrequency.

It is another object of the instant invention to have radiating elements that are compatible to the radome, i.e., conforming with its inner surface contour.

It is another object of the instant invention to provide a new and improved radome-antenna which is inexpensive and simple in design.

It is still another object of the instant invention to provide a radome-antenna structure which is both light in weight and conserves space.

It is still a further object of the instant invention to provide a new and improved radome-antenna structure which provides space for electrical components and/or other devices between the elements of structure.

SUMMARY OF THE INVENTION

In view of these and other objects, the instant invention contemplates a radome-antenna structure, wherein the radome is composed of low-loss dielectric material and is lined with a layer of electrically conductive material on the inner surface thereof. The layer of electrically conductive material has at least one aperture therethrough, and at least one radiating element aligned with the aperture. The radiating element extends into the space defined by the radome, and abuts the electrically conductive layer, while conforming to the inner surface of the radome. Preferably, the element consists of a dielectric substrate enclosed in an electrically conductive shield. By the afore-described structure, all radiation is retained outside of the radome and between the electrically conductive shield of each radiating element.

The specific nature of the invention, as well as other objects, aspects, uses and advantages thereof, will clearly appear from the following description and from the accompanying drawings.

BRIEF DESCRIPTION OF THE DRAWINGS

FIG. 2 is a top planar view, partly in section, showing one radiating element and a section of the radome wall;

FIG. 3 is a side view, in section, taken along lines 3—3 of FIG. 2, and FIG. 4 is a prospective view of a radiating element according to another embodiment of the instant invention.

DETAILED DESCRIPTION OF THE DRAWINGS

Figure 1:
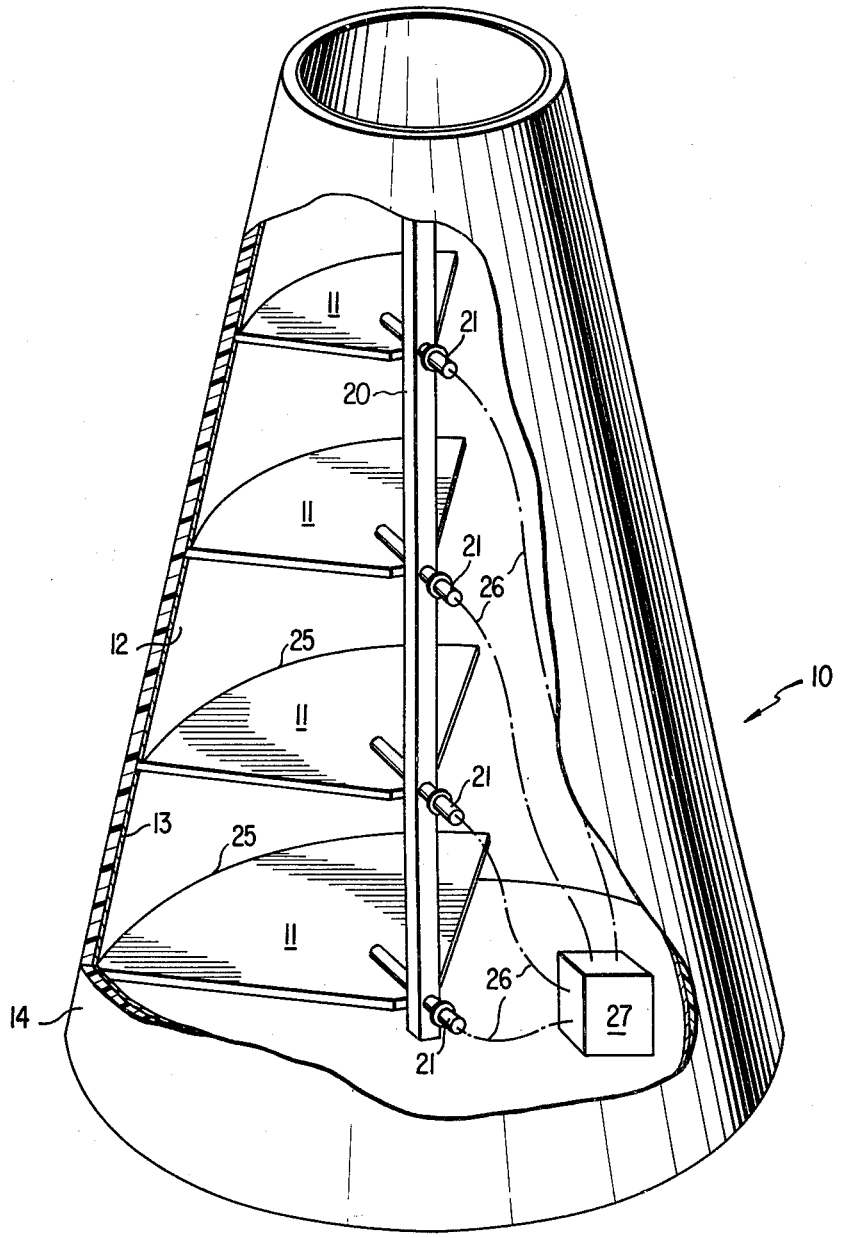
FIG. 1 is a prospective view, partly cutaway and partly in section, showing a radome-antenna structure according to the instant invention.

Referring now to FIG. 1, there is shown one embodiment of the instant invention, in which a radome, designated generally by the numeral 10, contains an array of radiating elements 11. Preferably, the radome is made of a material such as silicone fiberglass having low loss characteristics and a fairly low dielectric constant.

The radome 10 is lined with an electrically conductive material 12 over the inner surface 13 thereof. Preferably, the electrically conductive material is a very thin layer of copper on the order of two to three mils, which may be electrolessly plated on the surface 13. The outer surface 14 of the radome 10 is left unplated.

As seen in FIGS. 2 and 3, slots 16 extend through the layer 12, and are aligned with the radiating elements 11. Radiation emanating from the radiating elements 11, therefore, passes through the slots in the electrically conductive layer 12, and through the dielectric material 17 adjacent the slots out into the environment surrounding the radome 10. Since the layer 12 completely lines the interior surface 13 of the radome, none of the radio frequency radiation can be leaked or scattered back into the interior of the radome. Consequently, a shielded chamber is provided in the interior of the radome 10, which can be utilized to contain electronic circuitry which is sensitive to, and may be possibly adversely affected by, radio frequency radiation.

Referring now specifically to FIGS. 2 and 3, the structure of each radiating element 11 is shown in combination with the radome 10. Each radiating element 11 has a dielectric substrate 18, which may be made of a material such as teflon, embedded with fiberglass, and an electrically conductive shield 19, which completely surrounds the substrate. A coaxial input 21 is secured to each radiating elements 11. Each coaxial input 21 has a conductor 22 shielded by a sheath 23. The conductor 22 forms a coupling probe 22*a*, which passes through the substrate 18, and is bonded to the shield 19. The shield 19 is bonded with a solder or by other means to the layer 12.

As seen in FIGS. 1, 2 and 3, the radiating elements 11 may be supported at the inner ends thereof by a strut 20. The distance 24, from the inner end of each radiating element 11 to the coupling probe 22*a*, determines the impedance of that element. Consequently, the desired impedance may be selected by selecting the distance 24.

In manufacturing the type of radome-antenna structure shown in FIGS. 2 and 3, a preferred approach is to first bond the dielectric substrate 18 to the interior surface 13 of the radome 10 with epoxy, prior to forming the electrically conductive layers or shields 12 and 19 on the substrate and interior surface. The asembly consisting of the substrate 18 and the interior surface 13 of radome 10 may then be copper plated electrolessly or otherwise to provide the desired shielding, so as to prevent any radio frequency radiation from leaking or scattering into the interior of the radome.

As seen in FIGS. 1 through 3, the radiating elements 11 have ends 25 which have a curvature that matches the curvature of the interior surface 13 of the radome 10. Consequently, a rigid structure is provided, which does not leak radiation into the interior of the radome 10.

While a plurality of radiating elements 11 is shown in FIG. 1, it may be desirable to utilize only a single element. However, a plurality of elements can provide greater flexibility and can provide a multifunctional antenna. As is seen in FIG. 1, each of the coaxial inputs 21 is fed by a different cable 26, each of which is connected to a power source 27, which may be, for example, a power divider. With this arrangement, the separate radiating elements 11 may be energized at different frequencies and different power levels. In addition, the phases between the radiating elements 11 may vary, so that they are, for example, either inphase or out of phase. Great flexibility is, thus, obtainable with the array of radiating elements 11 arranged as shown in FIG. 1.

It should be kept in mind that the radiating elements 11 need not all be coplanar, but they may be at different angles relative to one another. In addition, the radiating elements 11 need not all be the same size or shape or thickness, and need not enclose the same angle. It is, however, desirable that the radiating elements 11 have edges 25, which conform to the contour of the inner surface 13 of the radome 10, and that the shield 19 enclosing each radiating elements cooperates with the layer 12 to shield the interior of the radome 10 from scattering radiation.

Referring now to FIG. 4, there is shown an additional embodiment of the invention, in which a radiating element 11*a* assumes the configuration of an annular disc. In this embodiment, the radiating element 11*a* is provided with a dielectric substrate 18*a* which is, in turn, plated with copper to form a shield 19*a*. The radiating element 11*a* has a central opening 28, which is plated, or otherwise electrically sealed, through which cables or other components, such as oscillators or various electronic circuits, mounted in the radome may extend or be located.

If desired, the radiating element 11*a* may be subdivided into segments to provide additional radiators operating at other frequencies, such as 29*a* and 29*b*, by aligning a series of plated-through holes 30 where the desired division takes place. In the illustrated embodiment, each segment provides, in essence, a separate antenna and each segment, therefore, is energized by a separate coaxial cable 26*a*. In the illustrated embodiment, the segments 29*a* are wedge shaped, whereas the segments 29*b*have parallel sides. It has been found that there is high electrical isolation between the segments 29*a* and 29*b*, which exceeds 30 decibels. It should be kept in mind, however, that the segments may assume any desired configuration, again, so long as no radiation leaks into the interior of the radome 10.

If desired, the plated-through holes 30 can be used to feed cables through from one level in the radome 10 to another.

It should be kept in mind that either a single element 11*a* may be utilized or a plurality of stacked elements, spaced along the axis of the radome in the manner shown in FIG. 1, may be utilized. It all depends upon the needs and desires of the designer. If there are a plurality of radiating elements 11*a* stacked in spaced relation along the radome, then they of course will have diameters conforming to the diameter of the radome at their locations. In other words, if the radome is conical, the successive radiating elements 11*a* will progressively decrease in size, as they approach the nose of the radome. Again, if there are a plurality of spaced radiating elements 11*a*, electrical components and the like may be disposed in the space between each radiating element.

While in the disclosed embodiment, the antenna conforms to a generally conical radome, it should be kept in mind that the radome-antenna structure may assume any desired configuration, and may for example be cylindrical or even spherical.

While the radiating elements 11 and 11*a*, illustrated in the drawings, extend normal to the axis of the illustrated radome 10, it is within the scope of this invention to orient the slots 16, so as to polarize the radiation in horizontal, vertical or inclined planes, so as to achieve polarization diversity.

The embodiments shown and described are exemplary of the invention, and various modifications can be made in construction and arrangement within the scope of the invention, which is limited only the appended claims.

We want it to be understood that we do not desire to be limited to the exact details of the construction shown and described, for obvious modifications can be made by a person skilled in the art.

What is claimed is:

1. A radome-antenna structure comprising:

a. a radome of low-loss dielectric material having inner and outer surfaces, wherein said inner surface defines a chamber;

b. a layer of electrically conductive material on said inner surface of said radome for forming a radiation shield thereover to exclude radiation from said chamber;

c. at least one aperture through said electrically conductive material;

d. at least one radiating element aligned with said aperture to direct radiation through said aperture, said element extending into said chamber, wherein said radiating element includes a dielectric substrate registered with said aperture and an electrically conductive shield enclosing said dielectric substrate, said shield abutting and conforming to said electrically conductive layer on the inner surface of said radome to contain said radiation therebetween.

2. The radome-antenna of claim 1, wherein there are a plurality of apertures through said electrically conductive material and at least one radiating element associated with each aperture.

3. The radome-antenna of claim 1, wherein the apertures are slots, and wherein the radiating elements are flat with thicknesses corresponding to the widths of the slots.

4. The radome-antenna of claim 1, wherein the radiating element is a disc and which is divided into a plurality of segments to provide a plurality of radiating segments in one plane.

5. The radome-antenna of claim 4, wherein the segments radiate with different characteristics.

6. The radome-antenna of claim 5, wherein the radiating elements are divided along lines defined by plated through holes.

7. The radome-antenna of claim 2, wherein the apertures are slots spaced from one another along the axial direction of the radome, so that both the slots and radiating elements are spaced, wherein each radiating element is powered by a separate cable, and wherein the radiation characteristics of each radiating element may be different.

8. The radome-antenna of claim 7, wherein the space between the radiating elements is used to accomodate electrical circuitry.

* * * * *